United States Patent [19]

Andersen

[11] 3,964,943

[45] June 22, 1976

[54] METHOD OF PRODUCING ELECTRICAL RESISTOR

[75] Inventor: Niels Lervad Andersen, Nordborg, Denmark

[73] Assignee: Danfoss A/S, Nordborg, Denmark

[22] Filed: Nov. 29, 1974

[21] Appl. No.: 528,076

Related U.S. Application Data

[62] Division of Ser. No. 442,485, Feb. 12, 1974.

[52] U.S. Cl. ..... 156/6; 13/25; 29/610 R; 156/8; 156/17; 338/322

[51] Int. Cl.[2] ..... H05B 3/66

[58] Field of Search ..... 264/42–44, 264/61, 344; 13/25; 156/7, 6, 77, 8, 17, 153, 154; 75/20 F, 204, 222; 338/322, 326, 328, 330, 333; 427/101, 243, 247; 29/610, 611

[56] References Cited

UNITED STATES PATENTS

| | | | |
|---|---|---|---|
| 2,735,881 | 2/1956 | Mann | 13/25 |
| 2,907,972 | 10/1959 | Schildhauer et al. | 13/25 X |
| 3,137,590 | 6/1964 | Coes | 338/330 X |
| 3,157,541 | 11/1964 | Heywang et al. | 148/174 |

*Primary Examiner*—William A. Powell

[57] ABSTRACT

The invention relates to an electrical resistor with a SiC body, particularly for ignition or heating purposes, and to a method of producing such electrical resistor.

5 Claims, 4 Drawing Figures

FIG. 1
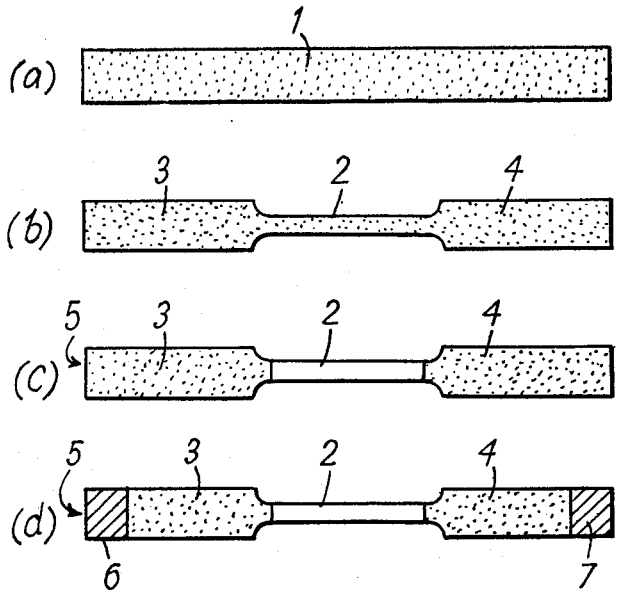
FIG. 2
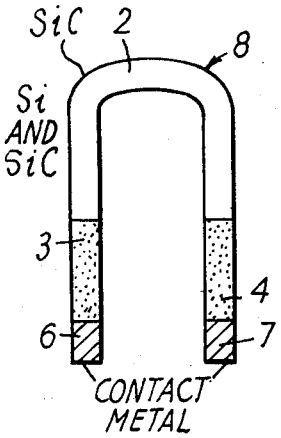
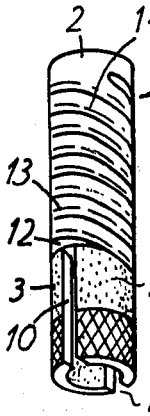
FIG. 3
FIG. 4
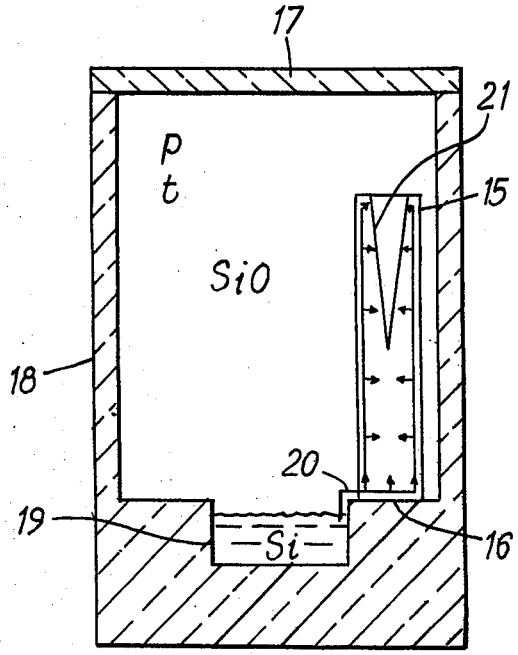

METHOD OF PRODUCING ELECTRICAL RESISTOR

This is a divisional application of Ser. No. 442,485 filed Feb. 12, 1974.

Electrical resistors are known that have bodies which, apart from the usual impurities and the required dopes or binding agents, are made of SiC. Such resistors are used mainly as heating elements or ignition means for heating installations. Since the usual SiC bodies also exhibit a certain NTC behavior, they are also used to detect the presence of a flame, and for other purposes. With SiC resistors of this kind, difficulties arise as regards the provision of contacts especially where resistive contacts are concerned. On the one hand the fusion of suitable metals, e.g. ytrium, requires extremely high temperatures, e.g. 2100°C. On the other hand, during use the contacts are subjected to the very high temperature of the SiC resistor body.

It is known, for the purpose of obtaining very dense SiC body of high mechanical strength, to form the body from $\alpha$-SiC and carbon, and to sinter the body under the effect of Si or a Si compound. In this method, the reaction between C and Si leads to the formation of additional SiC which to a large extent fills the pores present. In this method, also known as "reaction sintering", a certain proportion of free Si remains in the body depending upon the quantity of C used, the quantity of Si, and the size of the pores. In this connection, the carbon can also be produced by a conversion process, for example by thermal decomposition of a phenol resin or the like.

The Si compound or compounds can be provided in vapor form. Furthermore, liquid Si can be introduced from below into a porous body containing SiC and C, the liquid Si rising in the body by capillary action. In this connection it is also known in the case of bodies produced by drawing to treat these with SiO in the reaction sintering process, so that by removing part of the C in the surface zone, the surface porosity, that has been reduced by the drawing operation, is improved.

The object of the present invention is to improve a resistor of the initially stated kind by facilitating the attachment of the contacts and/or by increasing their service-life.

According to the invention this object is achieved by making the body of a median portion, consisting mainly only of SiC, and two end portions which, in addition to SiC also contain free Si.

The presence of Si greatly facilitates attachment of the contacts. In particular a larger number of contact materials can be attached at a lower temperature than in the past. Furthermore, the portion consisting of free Si greatly reduces the specific resistance, particularly as pure silicon has a high NTC coefficient above 200°C. Consequently, the end portions are less severely heated than the median portion when current passes through the body. As a result of the lower thermal loading, the service life of the contact is longer.

Particular advantage is achieved if there is applied to the end portions a metal which, with the free Si, forms a eutectic alloy which is largely resistively conducting. Such metals are known in semi-conductor practice. Aluminium for example forms a eutectoid with silicon at approximately 570°C, with silver at approximately 830°C, and with gold or antimony at 370°C. The contacts can therefore be applied at a relatively low temperature. Conversely, the low specific resistance resulting from the presence of free Si ensures that the contacts are not thermally loaded above the melting temperature of the eutectoid. It is also advantageous if a part of each end portion is left uncovered between the median portion and each connecting contact. In this way the contact is kept at a still greater distance from the median portion acting as an incandescent zone, and is subjected to a correspondingly low thermal load.

It has been found desirable for the end portions to contain 2 to 20% of free Si. These are average values measured over the entire cross-section; a higher proportion of Si is permissible in the edge zones.

Particular advantage accrues if the end portions consist of reaction-sintered SiC, since free Si can be introduced in such bodies in the required amount within the framework of a normal production method.

It is particularly preferred for the median portion to have a smaller cross-section than the end portions. With appropriate cross-sectional dimensions the resistance in the median portion can be adjusted to any required value within a wide range. The cross-sectional reduction can be present in the blank, or achieved by grinding after sintering.

According to the invention, a method for producing an electrical resistor is characterized in that a body containing SiC and free Si in its median portion is subjected to an etching operation which removes the free Si. In this method the resistor does not need to be made up from several parts and instead a one-part resistor is obtained. The etching results in a well-defined median portion and therefore a well-defined incandescent or heating zone. The end portions which are not to be etched can be masked, for example by means of a protective coating of paraffin or the like. Etching is preferably carried out in a mixture of nitric acid and hydrofluoric acid. The nitric acid so transforms the free silicon that it can then be dissolved by the hydrofluoric acid.

Furthermore, the median portion should be of smaller thickness than the end portions. Etching can therefore be carried out on two opposite relatively large surfaces. Since the etching rate is approximately 1 mm in 8 hours, then in the case of a 2 mm-thick median portion the free silicon is removed after 8 hours.

In a preferred embodiment, liquid Si is applied from below to a heated porous blank containing SiC and C, the silicon rising in the blank by capillary action, and the two end portions are formed at this lower end. With this procedure there is imparted to the lower part of the body a higher concentration of free Si either as a result of the use of liquid Si that becomes finely atomized, or as a consequence of the rate of upward migration of liquid Si through the pores. Consequently a greater quantity of free silicon is obtained in advance in the two end portions than in the median portion, so that a correspondingly smaller quantity of Si has to be removed from the median portion.

In this connection liquid Si can be applied for example to a blank bent to the shape of a U and having downwardly extending arms. In another arrangement, a tubular body is provided at the lower end with longitudinal slots for the purpose of forming the two end portions, and with further, in particular, helical slots extending to the longitudinal slots, for the purpose of forming the median portion.

Also, a porous blank made of SiC and C can be treated with SiO, at least in the zones of the end portions, prior to or during reaction sintering. This leads to greater porosity at the surface of the end portions so that a larger quantity of free silicon, for example 40 to 50%, can collect there, and this is desirable as regards the provision of the contacts.

The invention will now be described in greater detail by reference to the embodiments illustrated in the drawing, in which:

FIG. 1 is a diagrammatic illustration of the steps in the method for producing a resistor in accordance with the invention, FIG. 2 shows another form of resistor, FIG. 3 shows a third form of resistor, and FIG. 4 is a side view of the body shown in FIG. 2, during the reaction sintering.

In the method of production illustrated in FIG. 1, the starting material is a blank 1 made of reaction-sintered SiC. The Si contained therein is indicated by dots (FIG. 1*a*). The median portion 2 of this blank is ground down to a smaller thickness than the two end portions 3 and 4 (FIG. 1*b*). With the two end portions 3 and 4 masked, the median portion 2 is then etched with a mixture of nitric acid and hydrofluoric acid until practically no free Si is present in said median portion. There is thus obtained a body 5 which consists of a median portion 2, containing mainly only SiC, and two end portions 3 and 4, containing free Si in addition to SiC (FIG. 1*c*). Finally metal for forming the contacts 6 and 7 is applied to the two end portions 3 and 4 in such a way that part of each end portion remains uncovered between each contact and the median portion (FIG. 1*d*).

Suitable contact metals include aluminium, silver and gold with antimony. At relatively low temperatures such metals form with silicon a eutectoid that is resistively conducting. In this way there is obtained a mechanically and electrically stable resistive contact between the metal and the Si and SiC, by way of the eutectoid. The metals can be applied by flame-spraying, cathodic evaporation, vapour-deposition or any other method. During or after application of the metal, the latter can be stoved at a temperature above the melting temperature of the eutectoid. When the median portion 2 of the body 5 glows, the end portions 3 and 4 are only slightly heated because of the presence of free Si. Consequently there is no danger of the melting temperature of the eutectoid being reached at the contacts 6 and 7 during operation.

In the embodiment shown in FIG. 2, use is made of a body 8 bent to the form of a U; in this figure the median portion, the end portions and the contacts are designated by the same reference numerals as in FIG. 1.

The same applies as regards the tubular body illustrated in FIG. 3 in which the end portions 3 and 4 are separated by longitudinal slots 10 and 11. Adjoining the longitudinal slots are helical slots 12 and 13, so that the median portion 2 consists of two spirals 14 which are intertwined and which are interconnected only at the free end. Both of the resistor bodies 8 and 9 can be so produced by reaction sintering that the end portions 3 and 4 are disposed in the lower part. This results in there being a larger proportion of free Si in the end portions as will now be described in connection with FIG. 4 in which a blank 15 having the shape of the body 8 is shown diagrammatically in side view.

The blank 15 rests on a surface 16 in a crucible 18 closed by a lid 17. This crucible is raised to a temperature above the melting temperature of the Si contained in a channel 19. When the internal pressure $p$ corresponds to the atmospheric pressure, the temperature $t$ is at approximately 1600° to 1700°C. When the chamber is evacuated, the temperature may be reduced to 1500°C for example. The blank 15 consists of a mixture of $\alpha$-SiC granules and colloidal graphite. As a result of capillary action, liquid Si moves along the path 20 from the lower end into the blank 15. Penetration proceeds gradually in the upward direction and towards the middle, so that a gradually upwardly advancing reaction front 21 is created. When the reaction is complete, a somewhat greater proportion of free Si is present in the lower part of the blank 15, due on the one hand to the liquid Si atomizing from the channel 19 and on the other to the rate of upward migration of the Si. The higher proportion of Si in the end portions 3 and 4 facilitates the attachment of the contacts 6 and 7. The lower proportion of Si in the upper median part facilitates etching.

Furthermore, a certain quantity of $SiO_2$ can be added to the liquid Si. This results in the formation of a certain quantity of SiO vapour within the crucible. This vapour reacts with the C on the surface of the blank 15, half of the C being discharged as CO gas and the other half being converted into SiC. The removal of part of the C leads to larger pores at the surface, so that the liquid Si rises mainly at the edge of the blank 15, and upon completion of the reaction, the outer zone of the blank 15 has a higher content of free Si than the middle zone, for example 30% at the edge and 8% in the middle.

In this way there is obtained a SiC resistor having a mechanically and electrically stable resistive contact. It has low-resistance paths leading to the incandescent zone and therefore cool contact points. The position of the incandescent zone is well defined. The length of this zone and therefore of the incandescent resistor can be adjusted by means of the etching process. The operating temperature at the contacts is below the incandescent temperature, but may be as high as the eutectic temperature of the metal-silicon alloy.

In accordance with another procedure, the blank that is to be sintered, may be of the shape shown in FIG. 1*b* so that the grinding operation can be omitted or shortened.

I claim:

1. A method of producing a silicon carbide electrical resistor which comprises forming under pressure a dense and substantially nonporous body consisting essentially of silicon carbide and free silicon, and etching a middle portion of said body with acid to remove essentially all the free silicon therefrom to thereby obtain a middle portion consisting essentially of a porous matrix of silicon carbide free of silicon and two end portions consisting essentially of silicon carbide and free silicon.

2. A method according to claim 1 wherein a metal is applied to said end portions which forms a eutectic with free silicon in said end portions.

3. A method according to claim 2 wherein said body consists of silicon carbide and carbon, the amount of carbon being less than stoichiometric with respect to the amount of silicon diffused into the body, and wherein the body is subsequently sintered to cause the reaction in situ of said carbon and said silicon to provide said body consisting essentially of silicon carbide and free silicon.

4. A method according to claim 3 wherein before impregnation with silicon the body is treated with SiO at least in the region of said two end portions.

5. A method according to claim 1 wherein, before etching, the cross-sectional area of middle portion of the body is reduced relative to the cross-sectional area of the end portions by grinding.

* * * * *